US009232848B2

(12) United States Patent
Krikorian

(10) Patent No.: US 9,232,848 B2
(45) Date of Patent: Jan. 12, 2016

(54) CARRIER FOR SPORTS AND OTHER EQUIPMENT

(71) Applicant: Donald James Krikorian, Cranston, RI (US)
(72) Inventor: Donald James Krikorian, Cranston, RI (US)

( * ) Notice: Subject to any disclaimer, the term of this patent is extended or adjusted under 35 U.S.C. 154(b) by 120 days.
(21) Appl. No.: 13/999,456
(22) Filed: Feb. 28, 2014
(65) Prior Publication Data
US 2014/0339275 A1 Nov. 20, 2014

Related U.S. Application Data
(60) Provisional application No. 61/852,381, filed on Mar. 15, 2013.

(51) Int. Cl.
*A45F 3/04* (2006.01)
*A45F 3/08* (2006.01)
*A45F 3/14* (2006.01)

(52) U.S. Cl.
CPC ... *A45F 3/08* (2013.01); *A45F 3/04* (2013.01); *A45F 3/14* (2013.01); *A45F 2003/142* (2013.01)

(58) Field of Classification Search
CPC ..... A45F 3/08; A45F 3/04; A45F 2003/142
See application file for complete search history.

(56) References Cited

U.S. PATENT DOCUMENTS 3,233,803 A * 2/1966 Gray ..... A45F 3/04 224/153
4,308,982 A * 1/1982 Hall ..... A63C 11/025 224/250
4,673,070 A * 6/1987 Ambal ..... A45C 3/00 150/111
4,982,883 A * 1/1991 Ullal ..... A45F 3/14 224/643
5,350,096 A * 9/1994 Sieber ..... A45F 3/14 224/153
5,628,443 A * 5/1997 Deutsch ..... A45C 7/0086 150/113
5,729,869 A * 3/1998 Anscher ..... A45C 7/0086 224/272
5,732,867 A * 3/1998 Perkins ..... A45F 3/08 224/271
5,806,740 A * 9/1998 Carlson ..... A45F 3/047 224/259
5,878,928 A * 3/1999 Seiber ..... A45F 3/04 224/153
5,984,157 A * 11/1999 Swetish ..... A45F 3/10 224/631
6,202,907 B1 * 3/2001 Higgins ..... A45F 4/06 224/153
6,629,629 B2 * 10/2003 Lee ..... A45C 7/005 224/583
7,851,932 B2 * 12/2010 Rome ..... A45F 3/08 224/576
7,931,178 B2 * 4/2011 Rome ..... A45F 3/04 206/315.3
7,971,764 B2 * 7/2011 Sabbah ..... A45C 13/02 224/650
8,919,628 B2 * 12/2014 Jamlang ..... A45F 4/02 224/153
2004/0232180 A1 * 11/2004 Badillo ..... A45F 5/02 224/269
2005/0011982 A1 * 1/2005 Salentine ..... A45F 5/004 242/379.2
2006/0138188 A1 * 6/2006 Kramer ..... A45F 3/08 224/581
2007/0175941 A1 * 8/2007 Berry ..... A45C 7/007 224/583
2008/0041906 A1 * 2/2008 Rose ..... A45C 13/30 224/628
2009/0206118 A1 * 8/2009 Sabbah ..... A45C 13/02 224/652
2010/0059564 A1 * 3/2010 Bretl ..... A45F 3/16 224/414
2011/0278339 A1 * 11/2011 Hexels ..... A45F 3/08 224/676

* cited by examiner

*Primary Examiner* — Brian D Nash
(74) *Attorney, Agent, or Firm* — Michael de Angeli

(57) ABSTRACT

A carrier for carrying sporting equipment and other items comprises a base member that is assembled to a pair of shoulder straps, to be carried in the manner of a backpack. Depending on the type of equipment to be carried, one of a plurality of interchangeable equipment-specific members is selected and secured to the base member in a simple and efficient manner, without the use of tools. The chosen type of equipment to be carried is then secured to the corresponding equipment-specific member.

The base member may comprise a female dovetail joint, opening toward the top, and each of the equipment-specific members a corresponding male dovetail, so that the desired equipment-specific member can be assembled to the base member by simply sliding the male dovetail into the female dovetail, and gravity will retain the desired equipment-specific member in the desired position.

In a further improvement, the male dovetail may be part of an intermediate member, which allows relative rotation of the equipment-specific member though a limited range.

18 Claims, 3 Drawing Sheets

CARRIER FOR SPORTS AND OTHER EQUIPMENT

CROSS-REFERENCE TO RELATED APPLICATION

This application claims priority from Provisional Patent Application Ser. No. 61/852,381, filed Mar. 15, 2013.

FIELD OF THE INVENTION

The invention relates to a carrier for sports and other equipment, which can be adapted by assembly of various interchangeable equipment-specific members to a singular base member that can be carried on one's shoulders to permit convenient carrying of differing types of sports and other equipment. Specifically, the carrier of the invention comprises a base member that is assembled to a pair of shoulder straps, typically by way of a base board or backpack, so as to be carried in the manner of a backpack. Depending on the type of equipment to be carried, one of a plurality of equipment-specific members is selected and secured to the base member in a simple and efficient manner. The chosen type of equipment to be carried is then secured to the corresponding equipment-specific member.

In this way the assembly of the shoulder straps and base board or backpack and the base member can be used with various types of readily interchangeable equipment-specific members to carry various items of sports or other equipment, increasing the utility of the device.

BACKGROUND OF THE INVENTION

Various sorts of backpack-type devices are well-known, and many of these are equipped with specialized structure to adapt them to carrying specific equipment. For example, a backpack intended for mountaineering use might be equipped with a strap to receive a coil of rope, a pocket for a water bottle, straps to receive a rolled-up sleeping bag, and so forth.

The present invention differs from such backpack-type devices in that different interchangeable equipment-specific members can be assembled to a singular base member, so as to be adapted to carry different types of equipment when different activities are intended.

OBJECTS OF THE INVENTION

It is the object of the invention to provide a carrier for permitting different types of sporting and other equipment to be carried on one's back by means of a backpack-type structure, and wherein a basic assembly can be customized to carry various types of equipment by assembly of a particular interchangeable equipment-specific member thereto.

SUMMARY OF THE INVENTION

As summarized above, the equipment carrier of the invention comprises a base member that is assembled to a pair of shoulder straps, typically by way of an intermediate member, so as to be carried in the manner of a backpack. Depending on the type of equipment to be carried, one of a plurality of interchangeable equipment-specific members is selected and secured to the base member in a simple and efficient manner. The chosen type of equipment to be carried is then secured to the corresponding equipment-specific member.

More specifically, the base member may comprise a female dovetail joint, opening toward the top, and each of the equipment-specific members a corresponding male dovetail, so that the desired equipment-specific member can be assembled to the base member by simply sliding the male dovetail into the female dovetail, so that gravity retains the equipment-specific member in position, and so that the interchangeable equipment-specific members can be assembled to or removed from the base member without tools.

In a further improvement, the male dovetail may be part of an intermediate member, which allows relative rotation of the equipment-specific member though a limited range, which may be desirable for reasons of comfort.

Further aspects of the invention will become apparent as the detailed discussion thereof below proceeds.

BRIEF DESCRIPTION OF THE DRAWINGS

The invention will be better understood if reference is made to the accompanying drawings, in which.

DETAILED DESCRIPTION OF THE PREFERRED EMBODIMENTS

Figure 1:
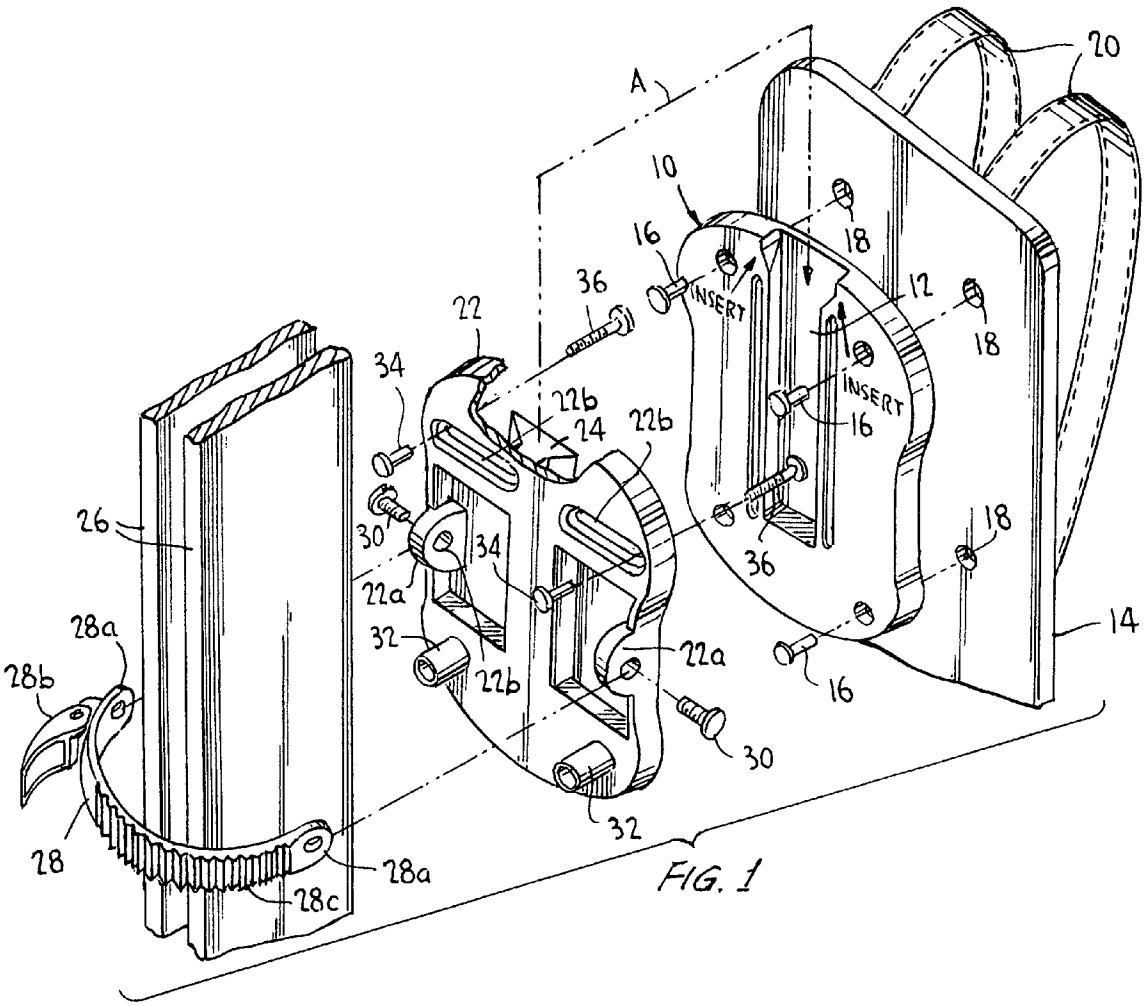
FIG. 1 shows an exploded view of the complete assembly of a first embodiment of the carrier of the invention, with an equipment-specific member intended for carrying a pair of skis.
Figure 2:
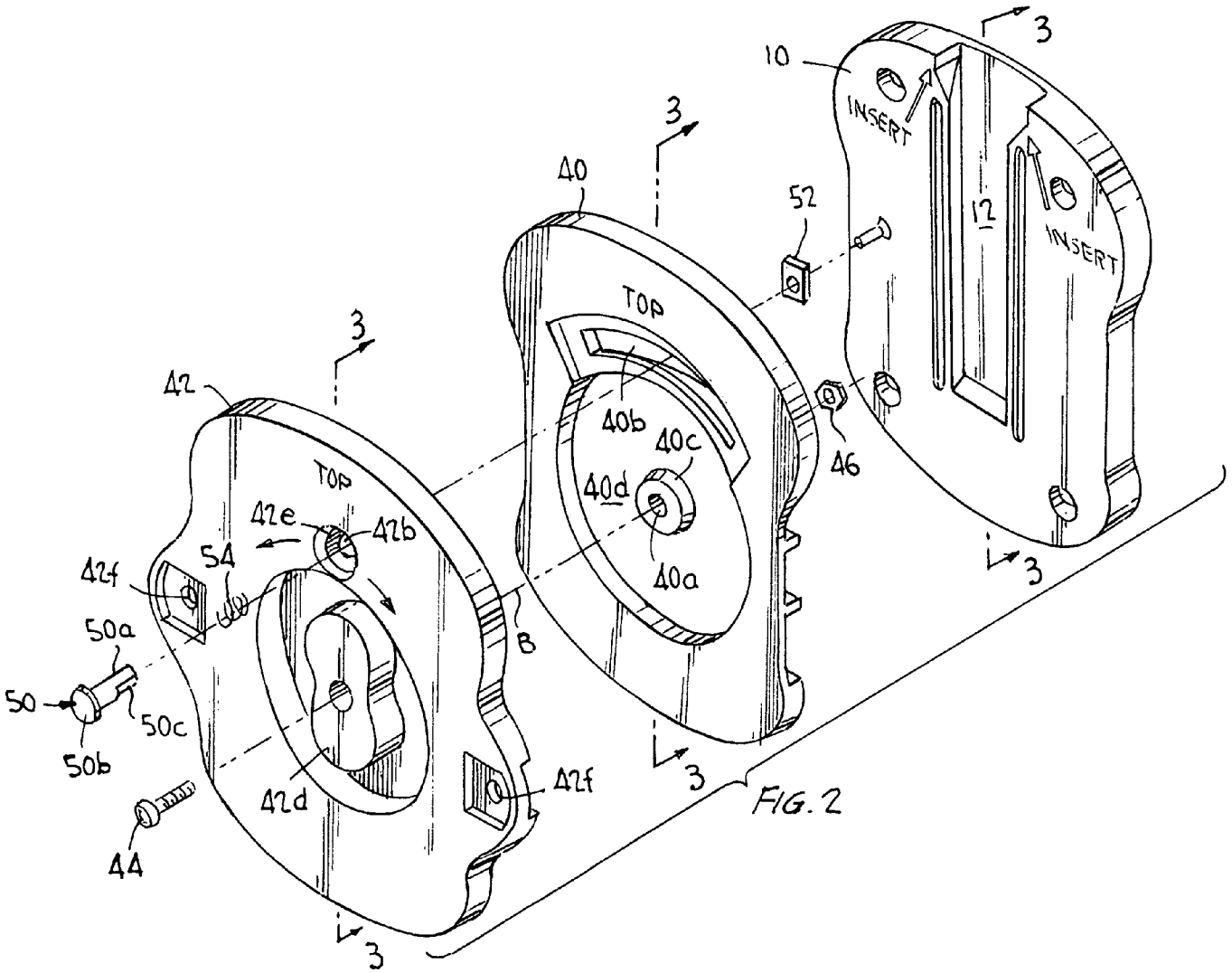
FIG. 2 shows an exploded view of a portion of a second embodiment, wherein the equipment-specific member is adapted for carrying a snowboard, and relative rotation thereof with respect to the base member is permitted.

As above, FIG. 1 shows an exploded view of the complete assembly of a first embodiment of the carrier of the invention, in this example with an equipment-specific member intended for carrying a pair of skis. In this embodiment, a generally planar base member 10, which is employed in all embodiments of the invention, comprises a female dovetail 12 (see FIG. 4) having an opening at the upper side of base member 10, as illustrated. Base member 10 may preferably be molded of plastic, with metallic fasteners employed as described below. Base member 10 is secured to a base board 14 by screws 16 threaded into inserts 18 secured to base board 18. Shoulder straps 20 are affixed to base board 14 by further fasteners (not shown). Shoulder straps 20 are sized and spaced, and made adjustable, so as to comfortably be worn by a person. Cross straps (not shown) connecting the shoulder straps 20 across the wearer's chest to enable further adjustment may be provided, as is well known in the art.

It is within the scope of the invention to fabricate base member 10 to be directly secured to shoulder straps 20. However, employment of base board 14 is preferred in order to spread the load over the wearer's back. Further, base board 14 may be configured as a backpack, that is, comprising fabric members providing pockets and the like.

A first embodiment of an equipment-specific member, in this case intended for carrying a pair of skis, is shown at 22. Equipment-specific member 22 is also generally planar and molded of plastic. Equipment-specific member 22 is shown partially cut away to show the upper end of male dovetail 24. Male dovetail 24 cooperates with female dovetail 12 formed in base member 10 so that equipment-specific member 22 can be readily assembled to base member 10 by lifting equipment-specific member 22 above base member 10 and lowering the former with respect to the latter, as indicated by arrow A, so that the male dovetail 24 is received within the female dovetail 12. See FIG. 4, as this aspect of the invention is common to all embodiments.

It will be appreciated that assembly of the equipment-specific member 22 to the base board 14 by interfitting dovetails as described allows gravity to keep the equipment-specific member 22 in the position shown as least as long as the carrier of the invention is kept in the orientation shown, i.e., in the upright orientation in which it is to be worn, and moreover that the equipment-specific member 22 can be removed and replaced as desired without requiring the use of tools.

As further illustrated in FIG. 1, in the example given the equipment-specific member 22 is intended to receive a pair of skis 26. Skis 26 are secured to equipment-specific member 22 by a strap 28, secured to equipment-specific member 22 at ends 28*a* by fasteners 30 fitting into and secured to cooperating structure 22*a* on equipment-specific member 22. Strap 28 may be a ratcheting strap, whereby the strap is tightened over the skis 26 by operation of a ratchet handle 28*b* on one end of strap 28, cooperating with teeth 28*c* on the other end of strap 28. Such ratcheting straps are well known in the art.

To further securely confine skis 26, one or more pairs of posts 32, 34 may be provided. As illustrated, one pair of posts 32 may be formed integrally or otherwise fixed to equipment-specific member 22, and a second set of posts 34 made adjustable by virtue of being secured to equipment-specific member 22 by fasteners 36 extending through transverse slots 22*b* formed in equipment-specific member 22. Posts 32, 34 may be disposed or adjusted so as to confine skis 26 or other equipment for secure carrying.

FIGS. 2-5 illustrate a second embodiment of the invention, in which a generally planar intermediate member 40, again molded of plastic with metallic fasteners being used where shown, is illustrated. Intermediate member 40 is interposed between the base member 10 and a different embodiment of an equipment-specific member 42. The assembly of the base member to a back board and carrying straps may as described above in connection with the FIG. 1 embodiment, and the equipment is attached to the equipment-specific member 42 by a strap or the like fixed to the equipment-specific member at 42*f*, also as described above. In this embodiment, the equipment-specific member 42 is intended to receive a snowboard.

The purpose of the intermediate member 40 is to permit the equipment-specific member 42 to be rotated through a limited range of rotation about a central pivot axis B, and secured in a desired angular position. In this way the position of the equipment to be carried can be varied as desired by the user, for reasons of comfort and convenience, e.g., so that the equipment does not tend to bump the user's legs while walking.

Figure 4:
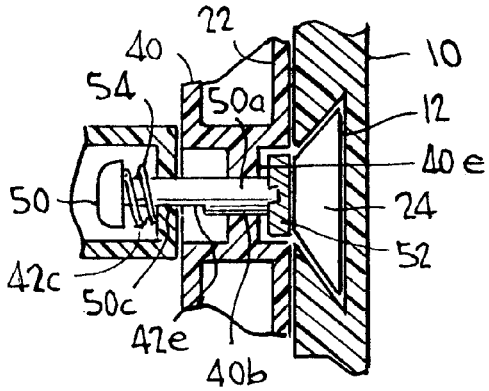
FIG. 4 is a partially cross-sectional view taken along the lines 4-4 of FIG. 3, showing a variation in position of some of the components.
Figure 5:
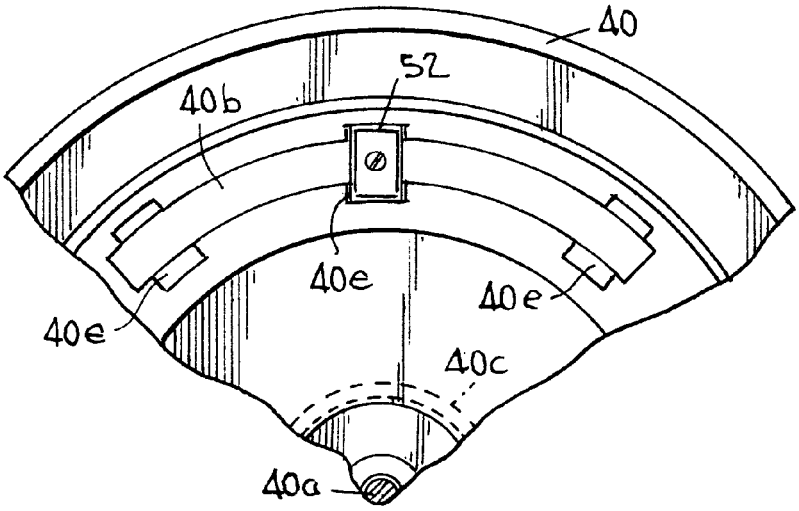
FIG. 5 is a partially cross-sectional view taken along the line 5 of FIG. 3.

The intermediate member 40 is secured to the base member 10 by a male dovetail, as described above in connection with the FIG. 1 embodiment, and as shown by FIG. 4. Intermediate member 40 is formed to define a central bore 40*a*, an arcuate slot 40*b*, and a central hub 40*c* proud of a circular recess 40*d*.

Figure 3:
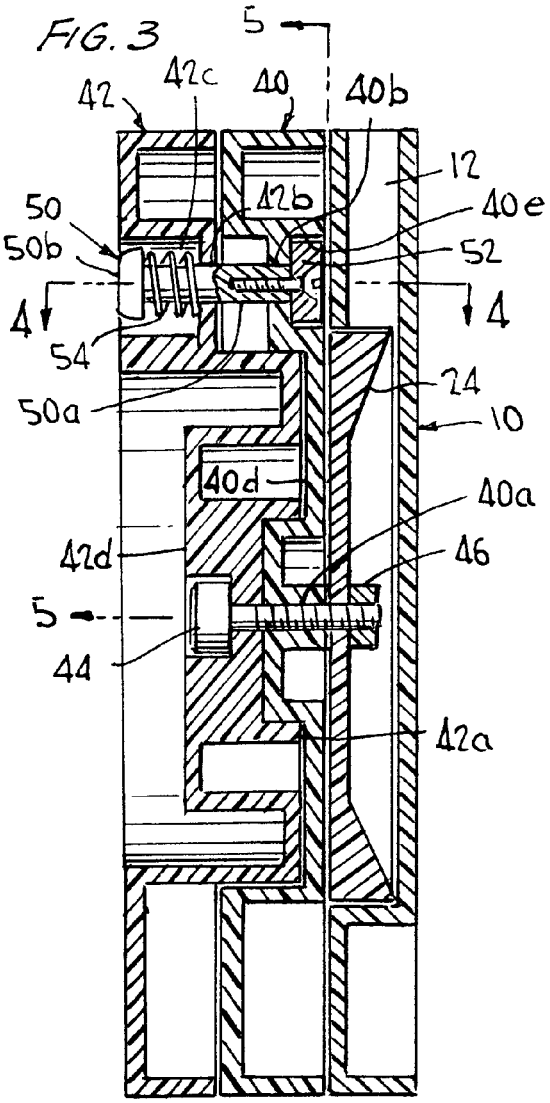
FIG. 3 is a partially cross-sectional view taken along the lines 3-3 of FIG. 2.

The equipment-specific member 42 is secured to the intermediate member 40 by a bolt 44 and a nut 46. Bolt 44 thus defines the pivot axis B, about which the equipment-specific member 42 rotates with respect to intermediate member 40. The male dovetail 24 may be formed as a separate member and secured to the intermediate member 40 by bolt 44, as illustrated in FIG. 3, or may be molded integrally with intermediate member 40. The equipment-specific member 42 comprises a tubular central member 42*a*, fitting around central hub 40*c*, so as to assist bolt 44 in bearing the weight of the equipment-specific member 42 and any associated equipment.

The range of rotation of the equipment-specific member 42 with respect to intermediate member 40 is limited by provision of a button 50 having an enlarged head 50*b* and a cylindrical shaft 50*a*. Shaft 50*a* rides in a bore 42*b* formed in equipment-specific member 42 and extends through arcuate slot 40*d* in the intermediate member, so that the range of rotation of the equipment-specific member 42 is limited by contact between the shaft 50*a* and the ends of the arcuate slot 40*d*.

Fixed to the end of shaft 50*a* opposite head 50*b* is a locator block 52. As illustrated in FIGS. 3 and 4, block 52 may be keyed to shaft 50*a* and secured thereto by a screw. Block 52 is sized to fit within one of several recesses 40*e* (see FIG. 5) formed in the rear side of intermediate member 40, disposed along and extending on inner and outer radial sides of arcuate slot 40*d*. A compression spring 54 is disposed around shaft 50*a* of button 50, and is confined between the head 50*b* thereof and a recess 42*c* formed in the equipment-specific member 42, biasing button 50 outwardly and thereby urging block 52 against the back of the equipment-specific member 42 on either side of the arcuate slot 40*d*. Accordingly, block 52 is urged into engagement with recesses 40*e*, locking the equipment-specific member 42 into one of a number of relative radial positions defined by the number of recesses 40*e*.

In order that the button 50 does not rotate, so that the locator block 52 remains correctly aligned with the recesses 40*a*, shaft 50*a* may be provided with a flat 50*c*, cooperating with a flat 42*e* formed in bore 42*b*. See FIG. 4. Bore 42*b* and shaft 50*a* could also be of corresponding non-circular cross-sectional shape, e.g., square, so as to prevent rotation. Alternatively, to avoid this small complexity, locator block 52 could be circular, and be received in partly-circular recesses 40*e*, such that radial orientation of block 52 would be immaterial.

Accordingly, when the user desires to move the equipment-specific member 42 from one radial position to another, he or she simply pushes onto the head 50*b* of button 50, urging block 52 out of the recess 40*e* it is then in, to the position shown in FIG. 4, and can then rotate the equipment-specific member 42 as desired. When the block 52 reaches the desired recess 40*e* the button 50 can be released and the block 52 will enter the desired recess under the urging of spring 54, securing the equipment-specific member 42 in the new desired position.

Other features of the preferred embodiment of the invention will be apparent from the drawings. Included in these are a member 42*d* formed integrally with the equipment-specific member 42 for the user to grip while adjusting the radial position thereof.

While the invention has been described in connection with the carrying of skis and snowboards, it will be apparent that many other types of elongated equipment could readily be carried by provision of suitably adapted equipment-specific members, of either the rotating type of FIGS. 2-5 or the non-rotating type of FIG. 1. Examples of such equipment include but are not limited to rifles and other hunting gear, fishing equipment, camping equipment, hockey and lacrosse equipment, military equipment, garden tools and other items.

As noted above, for simplicity the invention has been illustrated as employing a simple base board to which the base member 10 and shoulder straps 20 are attached, but the base board could be supplanted or augmented by a backpack, providing pockets and other structure for carrying various types of cargo. Therefore, reference herein and in the attached claims to a base board should not be construed to limit the invention.

Those of skill in the art will further recognize that various alternatives are within the scope of the invention. For example, the cooperating male and female dovetails could be replaced with other cooperating structure that would enable the base member 10 to be readily attached and removed from the equipment-specific member or intermediate member, such as plural smaller parallel dovetails, "T" or paired "L"-shaped interfitting members, and the like. The respective positions of the cooperating male and female dovetails could also be reversed. In each case the preferred arrangement is one in which cooperating elongated members are provided, one defining a passageway with an upper open end and a closed lower end, and the other defining a member fitting within and retained in the passageway, such that gravity will retain the associated members in the desired position while the carrier of the invention is being worn, while permitting removal and replacement of the equipment-specific member without the use of tools.

Therefore, while several preferred embodiments of the invention have been disclosed, the invention is not to be limited thereby, but only by the following claims.

What is claimed is:

1. A carrier for sporting or other equipment, comprising:

a base member;

a pair of shoulder straps affixed to said base member, allowing a user to wear said carrier;

an equipment-specific member adapted to receive and securely retain a predetermined item of sporting or other equipment;

said base member and equipment-specific member each comprising elongated members, one defining a passageway with an open end and a closed end, and the other comprising a member sized to be able to slid into and retained in the passageway, such that gravity will retain the associated members in the desired position while the carrier is being worn, while permitting removal and replacement of the equipment-specific member without the use of tools, and wherein said equipment-specific member comprises adjustable posts for defining a space within which a predetermined item of sporting or other equipment can be disposed.

2. The carrier of claim 1, wherein said passageway is provided in the base member and said member sized to be able to slide into and retained in the passageway is provided on the equipment-specific member.

3. The carrier of claim 1, wherein the passageway is configured as a female dovetail and said member sized to be able to slide into and retained in the passageway is configured as a male dovetail.

4. The carrier of claim 3, wherein the female dovetail is provided in the base member and the male dovetail is provided on the equipment-specific member.

5. The carrier of claim 1, wherein said equipment-specific member has assembled thereto at least one strap for retaining a corresponding predetermined item of sporting or other equipment.

6. The carrier of claim 5, wherein said strap is a ratcheting strap.

7. A carrier for sporting or other equipment, comprising:

a base member;

a pair of shoulder straps affixed to said base member, allowing a user to wear said carrier;

an intermediate member;

an equipment-specific member assembled to said intermediate member and adapted to receive and securely retain a predetermined item of sporting or other equipment;

said base member and said intermediate member each comprising elongated members, one defining a passageway with an open end and a closed end, and the other comprising a member sized to be able to slid into and retained in the passageway, such that gravity will retain the associated members in the desired position while the carrier is being worn, while permitting removal and replacement of the equipment-specific member without the use of tools; and wherein said equipment-specific member is permitted to rotate about an axis through a limited range of motion with respect to said intermediate member and be secured at a desired position along said range of motion.

8. The carrier of claim 7, wherein said passageway is provided in the base member and said member sized to be able to slide into and retained in the passageway is provided on the intermediate member.

9. The carrier of claim 7, wherein the passageway is configured as a female dovetail and said member sized to be able to slide into and retained in the passageway is configured as a male dovetail.

10. The carrier of claim 9, wherein the female dovetail is provided in the base member 10 and the male dovetail is provided on the intermediate member.

11. The carrier of claim 7, wherein said equipment-specific member has assembled thereto at least one strap for retaining a corresponding predetermined item of sporting and other equipment.

12. The carrier of claim 11, wherein said strap is a ratcheting strap.

13. The carrier of claim 7, wherein said equipment-specific member is adapted to be retained at one of several distinct positions along said range of motion.

14. The carrier of claim 13, wherein said base, intermediate and equipment-specific members are each generally planar and one of said intermediate and equipment-specific members is provided with an arcuate slot spaced from said axis and the other thereof with a pin fitting within said arcuate slot, whereby said arcuate slot limits the range of rotation of said equipment-specific member with respect to said intermediate member.

15. The carrier of claim 14, wherein said arcuate slot is provided on said intermediate member and said pin is provided on said equipment-specific member.

16. The carrier of claim 14, wherein a block wider than said arcuate slot is fixed to one end of said pin, said pin slides within a bore in the member in which it is provided, a plurality of recesses to receive said block are formed in the member in which said arcuate slot is formed, and said pin is spring biased to urge said block toward said recesses, whereby in order to move said equipment-specific member from one of said several distinct positions to another the pin is moved against said spring bias so as to urge said block out of one of said recesses, whereby said equipment-specific member is free to rotate about said axis.

17. The carrier of claim 11, wherein said equipment-specific member comprises structure confining the corresponding predetermined item of sporting or other equipment so as to be securely retained when said strap is tightened.

18. The carrier of claim 17, wherein said structure confining the corresponding predetermined item of sporting or other equipment comprises adjustable posts for defining a space within which the predetermined item can be disposed.

* * * * *